US008316949B2

(12) United States Patent
Rooks

(10) Patent No.: US 8,316,949 B2
(45) Date of Patent: Nov. 27, 2012

(54) INTAKE FOR SHROUDED ELECTRIC SUBMERSIBLE PUMP ASSEMBLY

(75) Inventor: Mark K. Rooks, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 410 days.

(21) Appl. No.: 12/619,172

(22) Filed: Nov. 16, 2009

(65) Prior Publication Data

US 2010/0122818 A1 May 20, 2010

Related U.S. Application Data

(60) Provisional application No. 61/114,810, filed on Nov. 14, 2008.

(51) Int. Cl.
*E21B 43/00* (2006.01)

(52) U.S. Cl. ..... 166/369; 166/68; 166/69; 166/105; 166/107; 166/372

(58) Field of Classification Search ..... 166/68, 166/105, 107, 369, 370, 372, 69
See application file for complete search history.

(56) References Cited

U.S. PATENT DOCUMENTS

| | | | | |
|---|---|---|---|---|
| 4,749,034 | A * | 6/1988 | Vandevier et al. | 166/105 |
| 4,832,127 | A * | 5/1989 | Thomas et al. | 166/369 |
| 6,595,295 | B1 | 7/2003 | Berry et al. | |
| 6,598,681 | B1 | 7/2003 | Berry | |
| 6,691,782 | B2 | 2/2004 | Vandevier | |
| 6,840,324 | B2 | 1/2005 | Pettigrew | |
| 6,932,160 | B2 | 8/2005 | Murray et al. | |
| 7,208,855 | B1 | 4/2007 | Floyd | |
| 7,401,655 | B2 | 7/2008 | Vandevier et al. | |
| 2003/0127223 | A1 | 7/2003 | Branstetter et al. | |
| 2005/0194126 | A1 | 9/2005 | Wang | |
| 2012/0012332 | A1 * | 1/2012 | Rooks | 166/369 |

FOREIGN PATENT DOCUMENTS

GB 2438515 A 11/2007

OTHER PUBLICATIONS

"REDA Maximus, High-reliability plug-and-play ESP systems with integrated downhole measurement technology" Schlumberger brochure, www.slb.com/artificiallift, 6 pages, Aug. 2006.
"REDA Maximus Motors" Schlumberger brochure, www.slb.com/artificiallift, 2 pages, Aug. 2006.
"REDA Maximus Protectors" Schlumberger brochure, www.slb.com/artificiallift, 2 pages, Aug. 2006.
"REDA Maximus ProMotor Unit" Schlumberger brochure, www.slb.com/artificiallift, 2 pages, Nov. 2006.

(Continued)

*Primary Examiner* — Giovanna Wright
(74) *Attorney, Agent, or Firm* — Bracewell & Giuliani LLP

(57) ABSTRACT

An electric submersible pump (ESP) assembly comprises an integrated sub-assembly encased within a shroud. The integrated sub-assembly comprises a downhole monitoring gauge, a motor, a well fluid intake, a seal section, a mounting member, and an electrical conduit extending between the mounting member and the motor. The intake has a plurality of intake slots positioned a select distance from the mounting member in order to minimize the space for the accumulation of gas within the shroud. The electrical conduit sealingly extends through the mounting member to a receptacle located on an upper portion thereof. Conductors are encased within the conduit and are connected between the receptacle and the motor. The conduit prevents the conductors from being affected by reservoir fluid and pressures.

6 Claims, 2 Drawing Sheets

OTHER PUBLICATIONS

"Poseidon Multiphase Gas-Handling System" Schlumberger brochure, www.slb.com/oilfield, 2 pages, Aug. 2003.

"Poseidon Multiphase Gas-Handling System Case study: Increasing oil production in fields with high gas cut" Schlumberger brochure, www.slb.com/oilfield, 2 pages, Aug. 2003.

"Gas Solutions Technology for Submersible Pump Applications, Efficiently produce high GOR wells with submersible pumps" Schlumberger brochure, www.slb.com/oilfield, 5 pages, Apr. 2004.

* cited by examiner

INTAKE FOR SHROUDED ELECTRIC SUBMERSIBLE PUMP ASSEMBLY

This application claims priority to provisional application Ser. No. 61/114,810, filed Nov. 14, 2008.

FIELD OF THE INVENTION

This disclosure relates in general to electric submersible pump assemblies and in particular to shrouded electric submersible pump assemblies.

BACKGROUND OF THE INVENTION

In many electric submersible pump (ESP) operations, deep set packers are required to protect casing annulus from contact with reservoir fluid and as a barrier for well control. In these cases, the ESP is located below the packer, which requires a packer penetrator system to be used to connect the ESP's electrical power cable above the packer to the motor lead cable below. In these applications, the penetrator system and the lower motor lead cable can represent a major failure mode for the ESP. Often, a high percentage of failures are directly related to the packer penetrator, motor lead cable, or motor pot head. Additionally, as the packer above the ESP creates a pressure boundary in the annulus, ESP's can not produce with pump intake pressures below the fluid bubble point pressure without creating gas pockets below the packer. This phenomenon often causes operators to reduce production rates from a well as draw downs are restricted to maintain certain pump intake pressures.

An alternative to the conventional packer/ESP installation discussed above is to modify the completion to incorporate the packer below the ESP, thus maintaining the integrity of the casing profile. Because the packer is located below the ESP, the ESP is run inside a concentric encapsulated shroud sealingly connected to a portion of the ESP. The shroud is connected to the ESP above the pump discharge head. The shroud is ultimately connected to a tailpipe/stinger which is inserted into the packer below. The power cable is connected to a penetrator system that passes through an upper portion of the shroud and connects to the motor lead cable below. This design requires a penetrator system through the shroud and it further requires that the penetrator either be spliced to the motor lead cable or be factory molded to the motor lead cable within the shroud. As such, both the failure modes noted above exist. Additionally, in this particular design, due to the location of the upper portion of the shroud relative to the pump intake, a pocket of gas may accumulate within the shroud. As a result, pump intake pressures at or below bubble point pressures are not desirable.

A need exists for a technique that reduces ESP assembly failures associated with cable penetrator systems and motor lead cables. Additionally, a need exists for a technique that allows an ESP to produce at or below bubble point pressures when deep set packers are required. The following technique may solve one or more of these problems.

SUMMARY OF THE INVENTION

An electric submersible pump (ESP) assembly comprises an integrated sub-assembly encased within a shroud. The integrated sub-assembly comprises a downhole monitoring gauge, a motor, a well fluid intake, a seal section, a mounting member, and an electrical conduit. The intake, seal section, motor, and monitoring gauge are connected to an under side of the mounting member. The intake has a plurality of intake slots positioned a select distance from the under side of the mounting member in order to minimize the space within the shroud for the accumulation of gas.

The electrical conduit extends between the mounting member and the motor. The conduit sealingly extends through the mounting member before connecting to a receptacle located on an upper side of the mounting member. Conductors are encased within the conduit and are connected between the receptacle and the motor. The conduit prevents the conductors, and thus the electrical connection for the motor from being affected by reservoir fluid and pressures.

A tailpipe/stinger is connected to a lower portion of the shroud and is adapted to penetrate a packer when lowered into a well. The tailpipe has a plurality of apertures located in and extending therethrough that allow fluid communication from the outside to the inside of the shroud.

A neck with a connector flange on its upper end extends radially upward from the upper side of the end plate, above the shrouded sub-assembly. A pump with a connector flange on its lower end is connected to the connector flange on the neck of the mounting member, thereby connecting the sub-assembly to the pump.

A power cable is connected to the receptacle on the upper side of the mounting member, thereby providing electricity to the motor though the conductors encased within the conduit. The ESP assembly is lowered into a well penetrating the packer. The motor drives the pump, which draws reservoir fluid in through the tailpipe before flowing by the integrated sub-assembly components and into the intake. The fluid then continues upwards through the pump and up to the surface through production tubing.

DETAILED DESCRIPTION OF THE INVENTION

Figure 1:
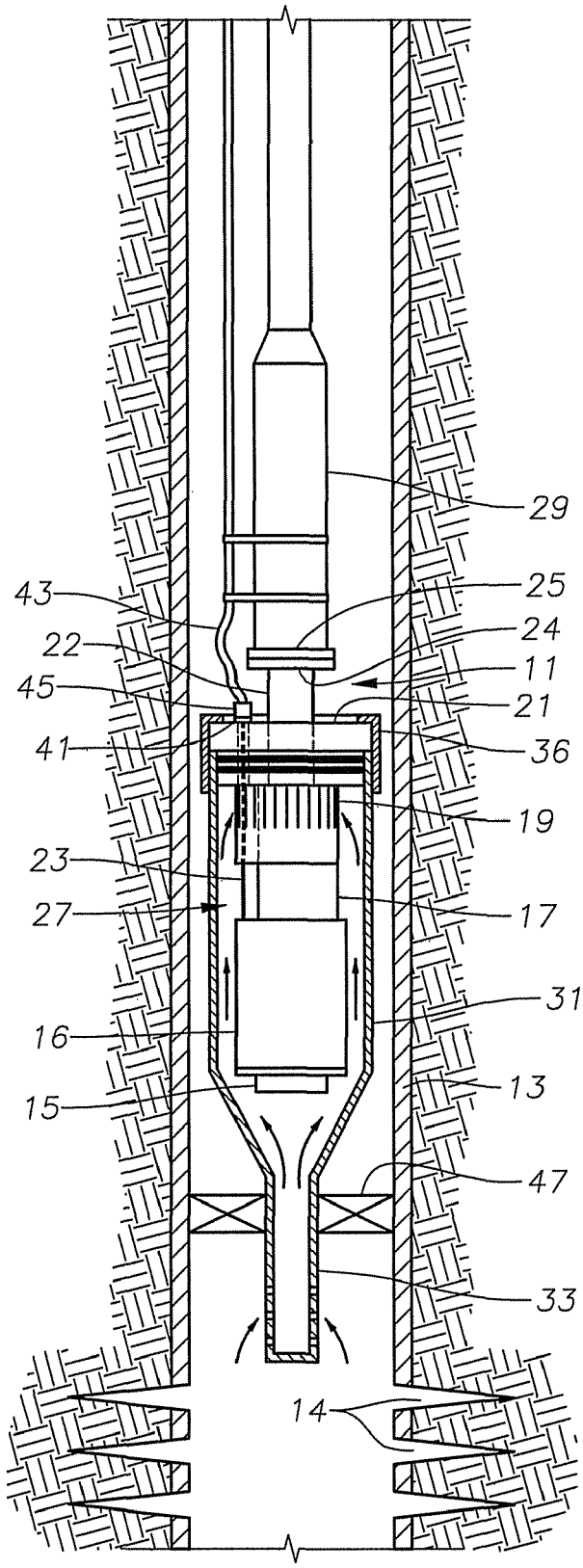
FIG. 1 is a schematic view of a shrouded electric submersible pump (ESP) assembly constructed in accordance with the present invention and supported in a wellbore.
Figure 2:
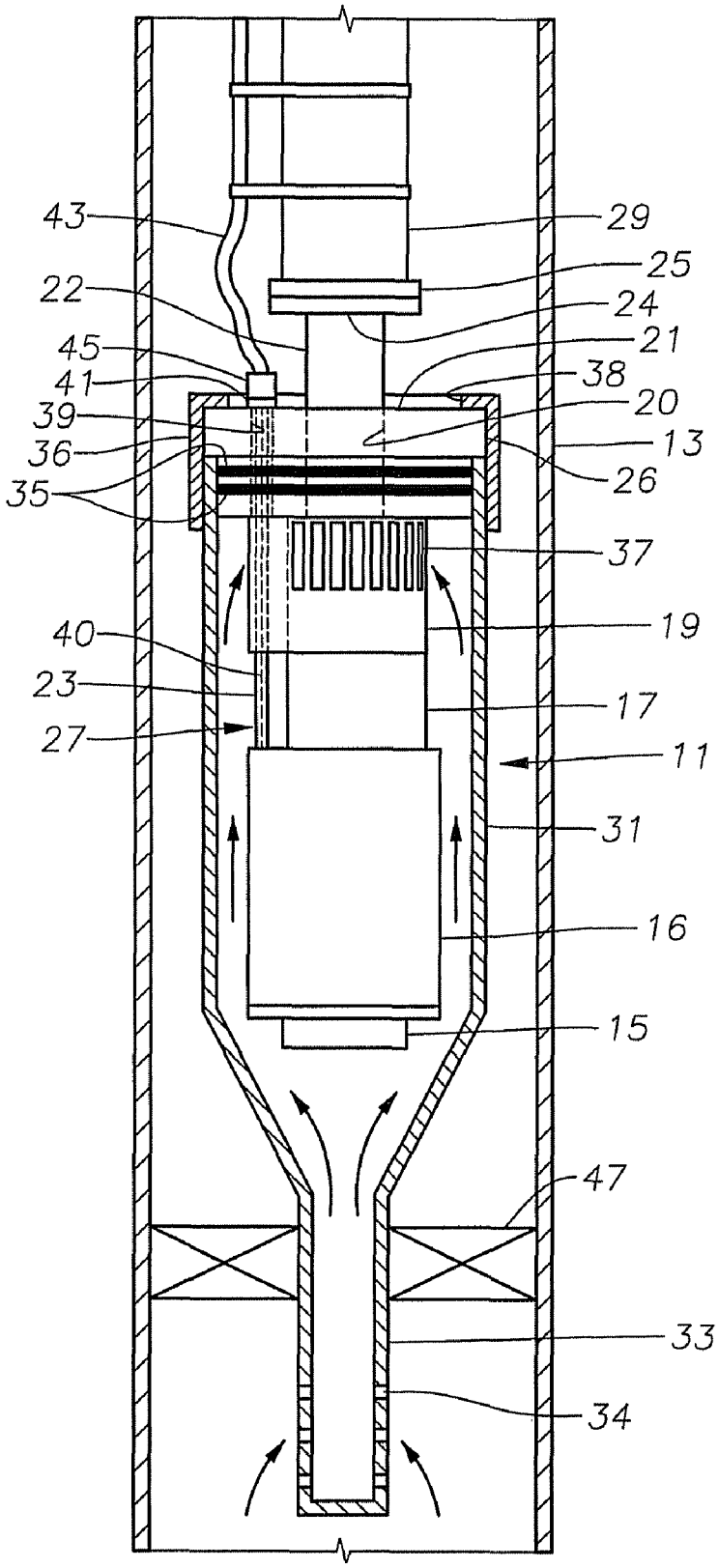
FIG. 2 is an enlarged view of a portion of the ESP assembly of FIG. 1.

FIG. 1 shows a completed well with a downhole, electric submersible pump (ESP) assembly 11 lowered down the casing 13 to above the perforations 14 in the well. The well produces a mixture of viscous oil and water. Referring to FIG. 2, ESP assembly 11 comprises a downhole monitoring gauge or sensor 15, a motor 16, a seal section 17, a well fluid intake 19, a mounting member 21, an electrical conduit 23, and a connector flange 25, all of which are supplied pre-assembled and form an integral sub-assembly 27. In one embodiment, sensor 15 may provide motor temperature, ambient temperature, and pressure readings. Mounting member 21 is a cylindrical tubular member joined on its lower side to intake 19. Mounting member 21 has an upper flange portion 26 having a greater diameter than a lower portion. Mounting member 21 has an axial passage 20 extending therethrough. Mounting member 21 has a tubular neck 22 joined to upper flange portion 26 and extending upward. Neck 22 has a flange 24 on its upper end.

ESP assembly 11 further comprises a pump 29. Pump 29 is a rotary pump driven by a shaft assembly extending from motor 16 through seal section 17. In the preferred embodiment, pump 29 is a centrifugal pump having a large number of stages, each stage having an impeller and a diffuser. Pump 29 could also be a progressing cavity pump, which has a helical rotor that rotates within an elastomeric stator. Pump 29 has a flange 25 on its lower end that bolts to flange 24. Motor 16 is an upper tandem (UT) type and is typically a three-phase AC motor that is filled with dielectric lubricant. Seal section 17 seals well fluid from entry into motor 16 and also has a pressure equalizing device, such as a bladder or labyrinth design for equalizing the lubricant pressure with the hydrostatic pressure of the well fluid. Seal section 17 also allows lubricant to thermally expand and contract, and incorporates a thrust bearing for carrying the axial thrust load from pump 29. Motor 16 rotates the shaft assembly that extends through seal section 17 and terminates within neck 22. Pump 29 has a shaft that couples to a splined end on the shaft assembly in neck 22.

Downhole monitoring gauge 15, UT motor 16, seal section 17, intake 19, and portions of mounting member 21 and electrical conduit 23 are all encapsulated within a shroud 31. Pump 29 is located above shroud 31 and sub-assembly 27 and neck 22 protrudes above the upper end of shroud 31. A tailpipe/stinger 33 is connected to the lower end of shroud 31. A plurality of perforations or apertures 34 are located in and extend through the tailpipe 33, thereby permitting fluid flow from the outside to the inside of shroud 31.

Integral sub-assembly 27 is placed within shroud 31 and is secured to it by way of a threaded cap 36, which slides over and surrounds mounting member 21. Cap 36 has an aperture 38 on its upper end that allows access to portions of the upper side of mounting member 21 and also allows neck 22 to extends upwards therethrough. Upper flange portion 26 of mounting member 21 has an outer diameter at least equal to that of the inner diameter of the upper end of shroud 31, such that when the lower portion of mounting member 21 is inserted into shroud 31, the outer peripheries of upper flange portion 26 abuttingly contact the upper end of shroud 31. Elastomeric seals 35 ensure a positive seal between an outer diameter of the lower portion of mounting member 21 and an inner diameter of shroud 31. Cap 36 threads onto an upper portion of shroud 31 that also contains threads. Cap 36 ensures that upper flange portion 26 of mounting member 21 remains in abutting contact with the upper end of shroud 31.

Intake 19 contains a plurality of intake slots 37 within shroud 31. Intake slots 37 are spaced closely to the lower side of mounting member 21, thereby minimizing the space for the entrapment of gas within shroud 31. Bolts (not shown) secure connector flange 25 to connector flange 24. In this particular embodiment, intake 19 is an independent component of integrated sub-assembly 27. However, in an alternate embodiment, intake 19 and intake slots 37 may be formed as in integral part of seal section 17.

As the distance from mounting member 21 to motor 16 is known, the conventional motor lead cable is replaced with a tubular electrical conduit 23, which may be a rigid tube. Electrical conduit 23 has a lower end connected to the motor 16. Electrical conduit 23 extends alongside seal section 17 and has an upper end that extends through a sealed passage 39 in mounting member 21. The upper end of conduit 23 ends at a reciprocal plug-in terminal block or receptacle 41, located on the upper surface of mounting member 21. As a result, the power cable or conductors 40 within electrical conduit 23, extending from motor 16 to receptacle 41, may be entirely encapsulated in conduit 23, either as three individual conductors or within one large tube with all three conductors. In one embodiment, conduit 23 may be connected to motor 16 below, and mounting member 21 above with swage lock technology. Electrical conduit 23 acts as an impermeable power conduit extending from motor 16 to mounting member 21, thereby providing the electrical continuity for motor 16 during operation.

Receptacle 41 is connected to the power cable or conductors 40 extending through conduit 23. Terminal block 41 is capable of accepting a pothead style cable attachment. In order to supply electrical power to motor 16, a main power cable 43 extending from the surface has an end connector 45 that is connected or plugged-in to terminal block 41 on the top surface of mounting member 21.

In operation, sub-assembly 27, comprising sensor 15, motor 16, seal section 17, mounting member 21, and electrical conduit 23, is brought to the well site as a single integrated assembly. Pump 29 and shroud 31 are brought to the well site as separate and independent components of the ESP assembly 11. ESP assembly 11 will incorporate a packer 47 within casing 13 for maintaining the integrity of the casing profile and acting as a barrier for well control. Integrated sub-assembly 27 is placed inside the concentric encapsulated shroud 31 at the well site. As a result, the lower portion of mounting member 21 is inserted into shroud 31. Cap 36 is then placed over neck 22 and upper flange portion 26 of mounting member 21 and is threaded onto shroud 23, thereby ensuring that upper flange portion 26 of mounting member 21 abbutingly contacts the upper end of shroud 31, securely connecting sub-assembly 27 to shroud 31. Elastomeric seals 35 seal the surface between shroud 31 and the lower portion of mounting member 21.

Pump 29 is securely connected to sub-assembly 27 by way of bolting connector flange 25 to connector flange 24. Once pump 29 is securely connected to mounting member 21, power cable 43 and plug 45 are connected to receptacle 41 on the upper surface of mounting member 21. Once ESP assembly 11 is fully assembled, it is lowered into casing 13.

Tail pipe 33 extending from the bottom of shroud 31 is inserted into and penetrates a packer 47, which has been previously installed within casing 13. Once tail pipe 33 has penetrated packer 47, ESP assembly 11 may be operated.

Motor 16 receives power from electric cable 43 through the conductors 40 contained with power conduit 23 and thereby drives pump 29. Pump 29 suctions fluid from the well through apertures 34 in tail pipe 33 as indicated by arrows. The fluid flows past motor 16, acting as a coolant, and continue upwards into intake slots 37 on intake 19 as indicated by arrows. Fluid continues upwards through pump 29 and up to the surface through production tubing. As the fluid flows through shroud 31, conductors 40, encased within conduit 23, are unaffected by reservoir fluid or pressures.

The technique has significant advantages. The installation time of an ESP will be greatly reduced by incorporating the integrated sub-assembly 27. Additionally, the location of mounting member 21 relative to intake 19 and intakes slots 37 ensures any free gas developing within shroud 31 will be ingested into pump 29 before accumulating, thereby allowing the ESP to operate below the bubble point pressure. Furthermore, the technique eliminates the conventional motor lead cable and packer penetrator systems, thereby eliminating the risk of failure associated with those systems due to exposure to reservoir fluid and pressures.

While the technique has been shown in only one of its forms, it should be apparent to those skilled in the art that it is not so limited but is susceptible to various changes without departing from the scope of the technique.

The invention claimed is:

1. An apparatus for pumping fluids, comprising:

a shroud having an enclosed interior with a well fluid inlet on a lower end;

a mounting member sealingly mounted within an upper end of the shroud, the mounting member having:

an axial passage therethrough, a tubular neck protruding above the shroud, the neck having a connector flange on an upper end, an upper flange portion having an outer diameter equal to or greater than the inner diameter of the upper end of the shroud, and a lower portion having an outer diameter less than the upper flange portion; and wherein portions of a lower side of the upper flange portion are in abutting contact with the upper end of the shroud, and the outer diameter of the lower portion is sealingly engaged with the inner diameter of the upper end of the shroud;

a tubular well fluid intake joined to a lower side of the mounting member and having an aperture in fluid communication with the interior of the shroud;

a motor located below and connected to the tubular well fluid intake by a seal section, the motor and the seal section being located within the shroud;

an electrical conductor connected to and extending from the motor alone side the seal section and sealingly through the mounting member;

an electrical receptacle joining the conductor and mounted to an upper side of the mounting member;

a pump having a connector flange on a lower end that is bolted to the connector flange on the neck;

a power cable extending alongside the pump the power cable having an end connector that couples to the receptacle; and a cap surrounding the upper flange portion and having an aperture in an upper end thereof, the neck and the electrical receptacle extending therethrough, the cap in abutting contact with portions of an upper side of the upper flange portion, the cap threadingly engaging the outer diameter of the upper end of the shroud to thereby securely connect the mounting member to the shroud.

2. An apparatus for pumping fluids, comprising:

a shroud having an enclosed interior with a well fluid inlet on a lower end;

a mounting member sealingly mounted within an upper end of the shroud, the mounting member having an axial passage therethrough and a tubular neck protruding above the shroud, the neck having a connector flange on an upper end;

a tubular well fluid intake joined to a lower side of the mounting member and having an aperture in fluid communication with the interior of the shroud;

a motor located below and connected to the tubular well fluid intake by a seal section, the motor and the seal section being located within the shroud;

an electrical conductor connected to and extending from the motor alongside the seal section and sealingly through the mounting member;

an electrical receptacle joining the conductor and mounted to an upper side of the mounting member;

a pump having a connector flange on a lower end that is bolted to the connector flange on the neck;

a power cable extending alongside the pump, the power cable having an end connector that couples to the receptacle; and a cap surrounding portions of the mounting member and connected to the shroud, the cap thereby securely connecting the mounting member to the shroud.

3. The apparatus of claim 2, further comprising:

the cap surrounding an upper flange portion of the mounting member and having an aperture in an upper end thereof, the neck and the electrical receptacle extending therethrough, the cap in abutting contact with portions of an upper side of the upper flange portion, the cap threadingly engaging the outer diameter of the upper end of the shroud to thereby securely connect the mounting member to the shroud.

4. A method for pumping well fluid, comprising:

(a) providing a cap and providing a shroud having an enclosed interior with a well fluid inlet on a lower end, a mounting member having an axial passage therethrough and a tubular neck protruding upward from an upper side thereof, the neck having a connector flange on an upper end, a tubular well fluid intake joined to a lower side of the mounting member and having an aperture, a motor located below and connected to the tubular well fluid intake by a seal section, an electrical conductor connected to and extending from the motor alongside the seal section and sealingly through the mounting member, an electrical receptacle joining the conductor and mounted to an upper side of the mounting member, a pump having a connector flange on a lower end, and a power cable having an end connector;

(b) sealingly mounting the mounting member into an upper end of the shroud, thereby encasing the well fluid intake, the seal section, the motor, and the conductor within the shroud, placing the cap over portions of the mounting member and the shroud, and engaging the cap with the shroud to thereby securely connect the mounting member to the shroud;

(c) bolting the connector of the pump to the connector flange on the neck of the mounting member;

(d) extending a power cable alongside the pump, and connecting the power cable to the electrical receptacle to thereby provide electricity to the motor;

(e) lowering the assembly into a well;

(f) operating the motor in the well;

(g) flowing the well fluid past and in contact with the motor; and (h) directing the fluid into the intake and the pump, which pumps the well fluid to the surface.

5. A method for pumping well fluid, comprising:

(a) providing a cap having threads along a portion of its inner diameter, and threads on an outer diameter of the upper end of the shroud and providing a shroud having an enclosed interior with a well fluid inlet on a lower end, a mounting member having an axial passage therethrough and a tubular neck protruding upward from an upper side thereof, the neck having a connector flange on an upper end, a tubular well fluid intake joined to a lower side of the mounting member and having an aperture, a motor located below and connected to the tubular well fluid intake by a seal section, an electrical conductor connected to and extending from the motor alongside the seal section and sealing through the mounting member, an electrical receptacle joining the conductor and mounted to an upper side of the mounting member, a pump having a connector flange on a lower end, and a power cable having an end connector;

(b) sealingly mounting the mounting member into an upper end of the shroud, thereby encasing the well fluid intake, the seal section, the motor, and the conductor within the shroud, placing the cap over portions of the mounting member and the shroud, and engaging the cap with the shroud by threading the cap onto the shroud to thereby securely connect the mounting member to the shroud;

(c) bolting the connector flange of the pump to the connector flange on the neck of the mounting member;

(d) extending a power cable alongside the pump, and connecting the power cable to the electrical receptacle to thereby provide electricity to the motor;

(e) lowering the assembly into a well;

(f) operating the motor in the well;

(g) flowing the well fluid past and in contact with the motor; and (h) directing the fluid into the intake and the pump, which pumps the well fluid to the surface.

6. A method for pumping well fluid, comprising:

(a) providing a cap having an aperture in an upper end thereof and providing a shroud having an enclosed interior with a well fluid inlet on a lower end, a mounting member having an axial passage therethrough and a tubular neck protruding upward from an upper side thereof, the neck having a connector flange on an upper end, a tubular well fluid intake joined to a lower side of the mounting member and having an aperture, a motor located below and connected to the tubular well fluid intake by a seal section, an electrical conductor connected to and extending from the motor alongside the seal section and sealingly through the mounting member, an electrical receptacle joining the conductor and mounted to an upper side of the mounting member, a pump having a connector flange on a lower end, and a power cable having an end connector, the mounting member further comprising an upper flange portion having an outer diameter equal to or greater than the inner diameter of the upper end of the shroud, and a lower portion having an outer diameter less than the upper flange portion;

(b) sealingly mounting the mounting member into an upper end of the shroud, abbutingly contacting portions of a lower side of the upper flange portion with the upper end of the shroud and placing the cap over the upper flange portion and connecting the cap to the upper end of the shroud to thereby securely connect the mounting member to the shroud, and sealingly engaging the outer diameter of the lower portion with the inner diameter of the upper end of the shroud, thereby encasing the well fluid intake, the seal section, the motor, and the conductor within the shroud;

(c) bolting the connector flange of the pump to the connector flange on the neck of the mounting member;

(d) extending a power cable alongside the pump, and connecting the power cable to the electrical receptacle to thereby provide electricity to the motor;

(e) lowering the assembly into a well;

(f) operating the motor in the well;

(g) flowing the well fluid past and in contact with the motor; and (h) directing the fluid into the intake and the pump, which pumps the well fluid to the surface.

* * * * *

UNITED STATES PATENT AND TRADEMARK OFFICE

CERTIFICATE OF CORRECTION

PATENT NO. : 8,316,949 B2
APPLICATION NO. : 12/619172
DATED : November 27, 2012
INVENTOR(S) : Mark K. Rooks It is certified that error appears in the above-identified patent and that said Letters Patent is hereby corrected as shown below:

In Claim 1, Column 5, line 20 the claim language "the motor alone side the seal section" should read --the motor alongside the seal section--

In Claim 4, Column 6, line 29 the claim language "bolting the connector of the pump to the connector" should read --bolting the connector flange of the pump to the connector--

In Claim 5, Column 6, line 54 the claim language "the seal section and sealing through the mounting" should read --the seal section and sealingly through the mounting--

In Claim 6, Column 8, line 6 the claim language "end of the shroud abbutingly contacting portions" should read --end of the shroud abuttingly contacting portions--

Signed and Sealed this
Fifth Day of February, 2013

Teresa Stanek Rea

Teresa Stanek Rea
*Acting Director of the United States Patent and Trademark Office*